US009151031B1

(12) United States Patent
Roby

(10) Patent No.: US 9,151,031 B1
(45) Date of Patent: Oct. 6, 2015

(54) FOOT-ACTIVATED TOILET FLUSHING SYSTEMS

(71) Applicant: Daryl Roby, Kennesaw, GA (US)

(72) Inventor: Daryl Roby, Kennesaw, GA (US)

( * ) Notice: Subject to any disclaimer, the term of this patent is extended or adjusted under 35 U.S.C. 154(b) by 130 days.

(21) Appl. No.: 14/160,038

(22) Filed: Jan. 21, 2014

Related U.S. Application Data

(60) Provisional application No. 61/755,045, filed on Jan. 22, 2013.

(51) Int. Cl.
*E03D 5/00* (2006.01)
*E03D 5/08* (2006.01)

(52) U.S. Cl.
CPC ..... *E03D 5/08* (2013.01)

(58) Field of Classification Search
CPC ..... E03D 5/08; A47K 13/10
USPC ..... 4/405
See application file for complete search history.

(56) References Cited

U.S. PATENT DOCUMENTS

| | | | | |
|---|---|---|---|---|
| 3,536,294 | A | 10/1970 | Rodriguez | |
| 4,007,499 | A * | 2/1977 | Lin | 4/249 |
| 5,068,925 | A | 12/1991 | Salibi | |
| 5,170,513 | A * | 12/1992 | Ambooken et al. | 4/249 |
| 5,339,468 | A * | 8/1994 | Lin | 4/246.5 |
| 5,421,552 | A | 6/1995 | Wang et al. | |
| D529,579 | S | 10/2006 | Lopez | |
| 7,975,322 | B1 * | 7/2011 | Heller | 4/249 |
| 7,987,528 | B1 * | 8/2011 | Ross | 4/246.3 |
| 8,266,730 | B2 | 9/2012 | Ricca | |
| 2007/0044216 | A1 * | 3/2007 | Cosby | 4/246.1 |

* cited by examiner

*Primary Examiner* — Janie Christiansen
(74) *Attorney, Agent, or Firm* — RG Patent Consulting, LLC; Rachel Gilboy

(57) ABSTRACT

A foot-activated toilet flushing system is a device that can be retrofitted to an existing toilet to transform the flush valve from a hand operated flush valve to a foot operated flush valve to allow hands-free flushing for limiting the spread of pathogens.

19 Claims, 5 Drawing Sheets

FOOT-ACTIVATED TOILET FLUSHING SYSTEMS

CROSS-REFERENCE TO RELATED APPLICATION

The present application is related to and claims priority from prior provisional application Ser. No. 61/755,045, filed Jan. 22, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of toilet flush devices and more specifically relates to a foot-activated toilet flushing system.

2. Description of the Related Art

Urinals and toilets are in use in most of the modem world in homes and public rest rooms. A flush toilet is a toilet that disposes of human liquid and solid waste, by using water to flush it through a drainpipe to another location for disposal. The nature of these modern water using devices is that most have a hand actuated flush lever, button, or switch. Hand flush devices have been in limited use since the 1880's in the United States, but by the 1890's, there was a much greater awareness of disease and the flush toilet started becoming more common. Since that time, the design of toilets have changed somewhat, but the hand flushing mechanism still remains virtually the same.

Public rest rooms and residential bathrooms are the number one source for bacteria, viruses, and fungus, and also the most likely place for an individual to come into contact with them. These pathogens can be of a nearly unlimited variety and can originate from nearly anywhere in the world due to modern travel availability. The awareness of disease began the upward trend in the use of toilets, or "water closets" post 1890, but that is where the remedy for the problem seems to have halted. The hands are the medium in which restroom originated diseases are spread, but the awareness of this fact has not caught traction with the investors, manufacturers, and engineers. The redesigning and manufacturing of a new innovative toilet could be very expensive, and the increase in cost may not catch on with the general public. The public is slow to accept major changes that include price hikes, and this could be a problem for investors. A solution that would safely and inexpensively allow an individual to flush hands-free would go a considerable distance toward reducing the spread of bathroom bacteria, viruses, and fungus, and would be a welcome innovation.

Various attempts have been made to solve the above-mentioned problems such as those found in U.S. Pub. No. 7,975,322 to Allison Heller, U.S. Pat. No. 5,068,925 to S. Kamal Salibi, U.S. Pat. No. D529579 to Arturo Villalobos Lopez, U.S. Pat. No. 8,266,730 to Tom L. Ricca, U.S. Pat. No. 5,421,552 to Fang-Hsiung Chang, and U.S. Pat. No. 3,536,294 to Rodriguez Jose Pelaez. This art is representative of foot operated flushing devices. None of the above inventions and patents, taken either singly or in combination, is seen to describe the invention as claimed.

Ideally, a foot operated flushing device should provide low cost and convenience of installation, and yet, would operate reliably and be manufactured at a modest expense. Thus, a need exists for a reliable foot-activated toilet flushing system to avoid the above-mentioned problems.

BRIEF SUMMARY OF THE INVENTION

In view of the foregoing disadvantages inherent in the known foot operated flushing device art, the present invention provides a novel foot-activated toilet flushing system. The general purpose of the present invention, which will be described subsequently in greater detail, is to provide low cost and convenience for the installation of a foot-activated toilet flushing system.

The present invention, foot-activated toilet flushing system as disclosed herein, preferably comprises: a hands-free toilet flushing system having a foot flush assembly with a base plate having a top side, a bottom side, a first corner, a second corner, a third corner, and a forth corner, a first and a second guide rod, at least one compression spring, a foot flush plate having an upper and a lower side, a first through-hole and a second through-hole, a first vertical extension rod having a first end and a second end, a second vertical extension rod having a proximate end and a distal end, an adjustment plate having a plurality of through-orifices, an adjustment rod having a loop end, an adjustment end, a plurality of adjustment orifices, a pull ring, and an attachment strap.

The foot flush assembly is an apparatus that is attachable to a toilet flush handle that allows a user to be able to step on a foot flush plate to flush a toilet with for a hands-free operation. The foot flush assembly is an add-on device and retrofits to an existing toilet flush handle of a toilet. The foot flush assembly may comprise stainless steel or another suitable material that makes it rigid and corrosion resistant and is designed to reduce the spreading of germs by the user.

The base plate is substantially square with the bottom side of the base plate located adjacent to the surface of the floor beneath the flush handle of a toilet. The base plate may be about 6 inches square but may be larger or smaller in some embodiments. The first guide rod and the second guide rod are vertically positioned and rigidly attached to the top side of the base plate near opposing edges. The first guide rod located about mid way between the first and the second corners, and the second guide rod is located about mid way between the third and the fourth corners. The first and the second guide rods may be threadably fastened to the base plate and comprise a cylindrical profile. The compression springs are vertically attached to the top side of the base plate between the first and second guide rods. The user is able to easily compress the compression springs via the foot flush plate using one foot. The upper side and the lower side of the foot flush plate are integral and parallel planar to each other and may be at least 1½ inches wide and about 6 inches long.

The first and the second guide rods are able to keep the foot flush plate in vertical alignment. The foot flush plate is positioned atop the compression springs with the first and second guide rods slidably passing through the first and the second through-holes, respectively, of the foot flush plate. The foot flush plate is able to float upward and downward with the compression motion of the compression springs via the tension and compression forces. The first end of the first vertical extension rod and the proximate end of the second vertical extension rod is vertically and removably attached at opposite ends of the upper side of the foot flush plate so that the structure remains rigid. The second end of the first vertical extension rod and the distal end of the second vertical extension rod are perpendicularly fastened to the adjustment plate near the left and the right outside edges of the adjustment plate respectively.

The adjustment end of the adjustment rod perpendicularly passes through a centrally located through-orifice of the adjustment plate and adjustably fastens to the adjustment plate via the plurality of adjustment orifices of the adjustment end of the adjustment rod. The plurality of adjustment orifices of the adjustment rod are spaced about ½ inch apart and are able to adjust to multiple different heights to accommodate attachment to the toilet flush handles of different manufacturers.

The adjustment rod may also be fastened to the adjustment plate via at least one biasing clip such as an angel clip. The loop end of the adjustment rod is non-removably attached to the pull ring. The foot flush assembly is able to adjust to at least as low as 20 inches to couple to the toilet flush handle to flush the toilet, or as high as about 30 inches. The pull ring is coupled to the toilet flush handle via the attachment strap such that a single downward pressing motion on the foot flush plate via the foot of the user provides a single flush of the toilet. The attachment strap may preferably comprise hook and loop fasteners but may comprise a different attachment means in other embodiments.

A kit is embodied herein for the foot-activated toilet flushing system preferably comprising: at least one foot flush assembly having at least one base plate; at least one first and one second guide rod; at least two compression springs; at least one foot flush plate; at least one first and one second vertical extension rod; at least one adjustment plate; at least one adjustment rod having a pull ring at loop end and a plurality of adjustment orifices at adjustment end; at least one attachment strap; and a set of installation instructions.

A method of using the foot-activated toilet flushing system may comprise the steps of placing the user's foot on the foot flush plate and pressing downward on the foot flush plate to activate the toilet flush handle to flush the toilet.

The present invention holds significant improvements and serves as a foot-activated toilet flushing system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, foot-activated toilet flushing system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a foot operated flushing device and more particularly to a foot-activated toilet flushing system as used to lower the cost for the installation of a foot-activated toilet flushing system while providing greater convenience and safety.

Generally speaking, a foot-activated toilet flushing system is a device that can be retrofitted to an existing toilet to transform the flush valve from a hand operated flush valve to a foot operated flush valve that allows hands-free flushing for limiting the spread of pathogens.

Figure 1:
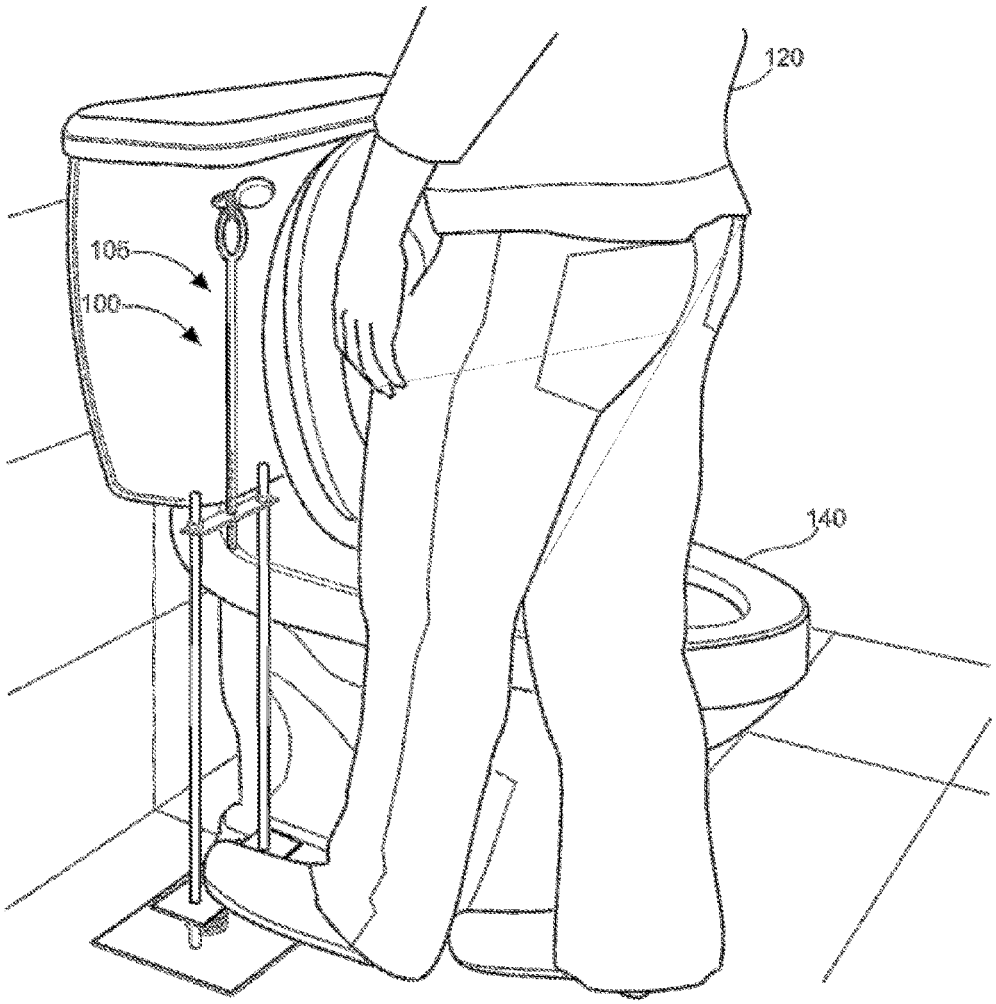
FIG. 1 shows a perspective view illustrating an in-use condition of a foot-activated toilet flushing system according to an embodiment of the present invention.

In greater detail now, referring to the drawings by numerals of reference, there is shown in FIG. 1, a perspective view illustrating an in-use condition of foot-activated toilet flushing system 100 according to an embodiment of the present invention.

Foot flush assembly 105 is an apparatus that is attachable to toilet flush handle 110 that allows user 120 to be able to step on foot flush plate 130 to flush toilet 140 with a hands-free operation. Foot flush assembly 105 is an add-on device and retrofits to an existing toilet flush handle 110 of an existing toilet 140. Foot flush assembly 105 may comprise stainless steel or another suitable material that makes it rigid and corrosion resistant and is designed to reduce spreading of germs by user 120. Compression springs 150 are able to easily be compressed by the weight of a user's 120 foot and then return toilet flush handle 110 to a non-activated position.

Figure 2:
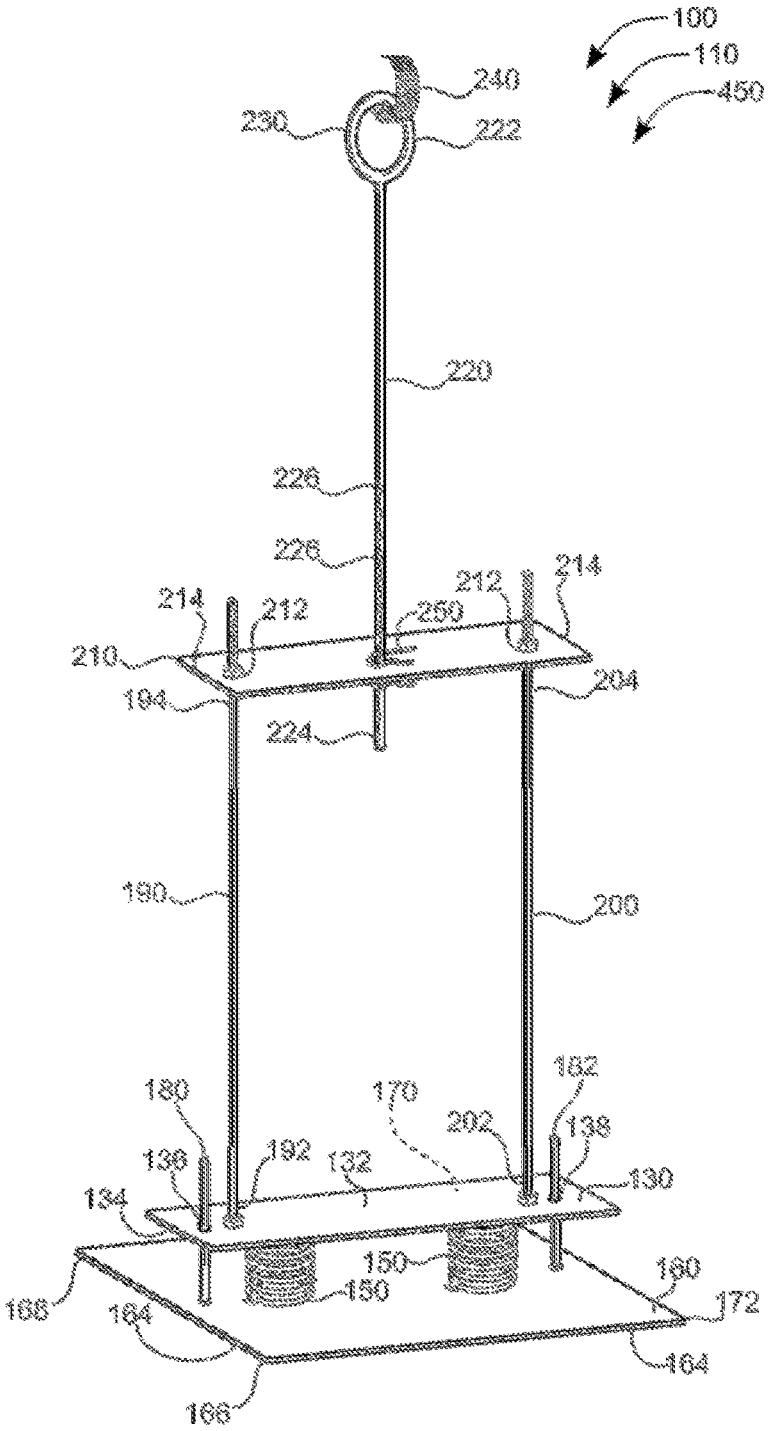
FIG. 2 is a perspective view illustrating the foot-activated toilet flushing system according to an embodiment of the present invention of FIG. 1.

Referring now to FIG. 2, a perspective view illustrating foot-activated toilet flushing system 100 according to an embodiment of the present invention of FIG. 1.

Foot-activated toilet flushing system 100 preferably comprises foot flush assembly 105 with base plate 160 having top side 162, bottom side, first corner 166, second corner 168, third corner 170, and forth corner 172, first 180 and second guide rod 182, at least one compression spring 150, foot flush plate 130 having upper 132 and lower side 134, first through-hole 136 and second through-hole 138, first vertical extension rod 190 having first end 192 and second end 194, second vertical extension rod 200 having proximate end 202 and distal end 204, adjustment plate 210 having a plurality of through-orifices 212, adjustment rod 220 having loop end 222, adjustment end 224, a plurality of adjustment orifices 226, pull ring 230, and attachment strap 240.

Figure 3:
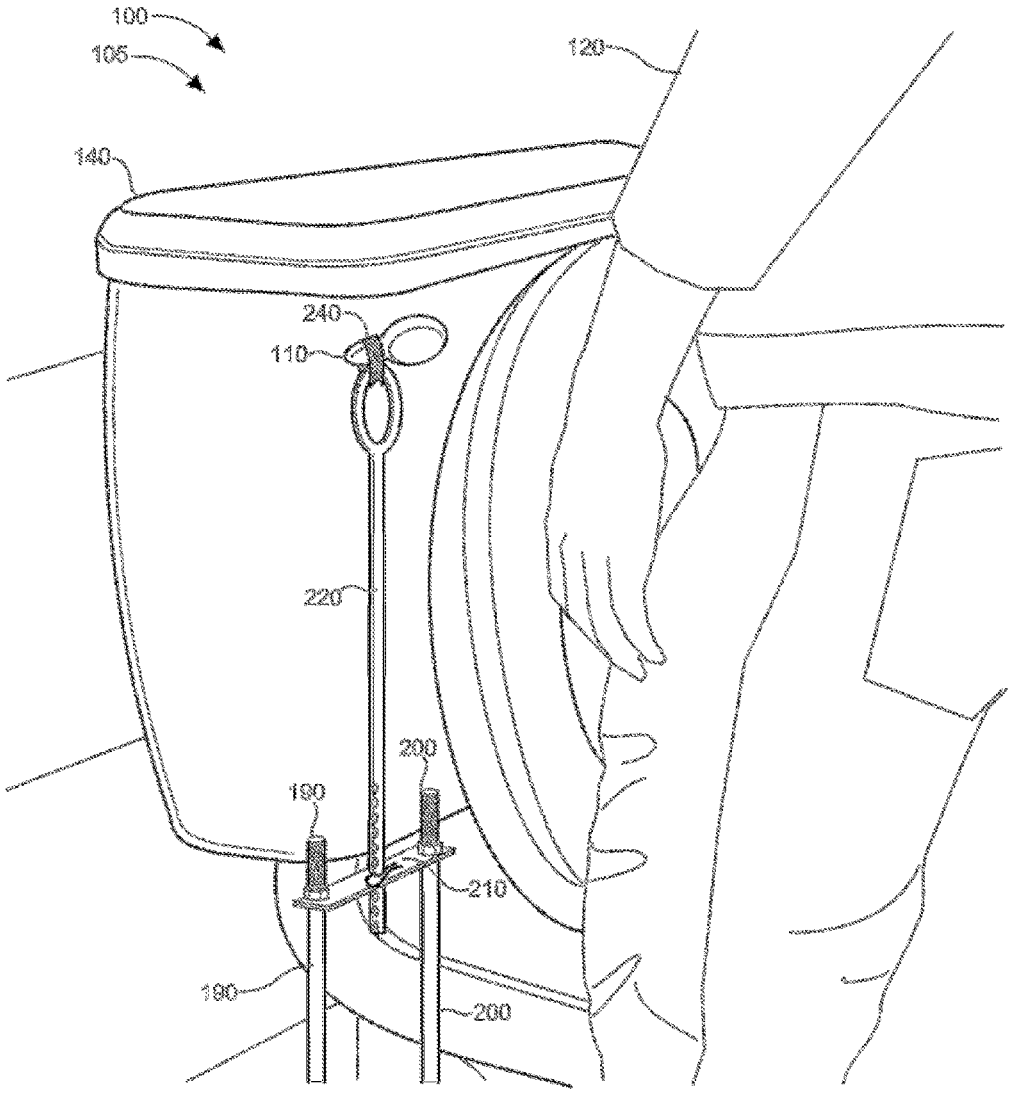
FIG. 3 is a perspective view illustrating a pull ring of a foot-activated toilet flushing system attached to a flush handle of a toilet according to an embodiment of the present invention of FIG. 1.

Referring now to FIG. 3, a perspective view illustrating pull ring 230 of foot-activated toilet flushing system 100 attached to toilet flush handle 110 of toilet 140 according to an embodiment of the present invention of FIG. 1.

Adjustment end 224 of adjustment rod 220 perpendicularly passes through a centrally located through-orifice(s) 212 of adjustment plate 210 and adjustably fastens to adjustment plate 210 via a plurality of adjustment orifices 226 of adjustment end 224 of adjustment rod 220. The plurality of adjustment orifices 226 of adjustment rod 220 are spaced about ½ inch apart and are able to adjust to multiple different heights to accommodate attachment to toilet flush handle(s) 110 of different manufacturers. Adjustment rod 220 may also be fastened to adjustment plate 210 via at least one biasing clip 250 such as angel clip 252.

Loop end 222 of adjustment rod 220 is non-removably attached to pull ring 230. Foot flush assembly 105 is able to adjust to at least as low as 20 inches or as high as about 30 inches to couple to toilet flush handle 110 to flush toilet 140. Pull ring 230 is coupled to toilet flush handle 110 via attachment strap 240 such that a single downward pressing motion on foot flush plate 130 via the foot of user 120 provides a single flush of toilet 140. Attachment strap 240 may preferably comprise hook and loop fasteners but may comprise a different attachment means in other embodiments.

Figure 4:
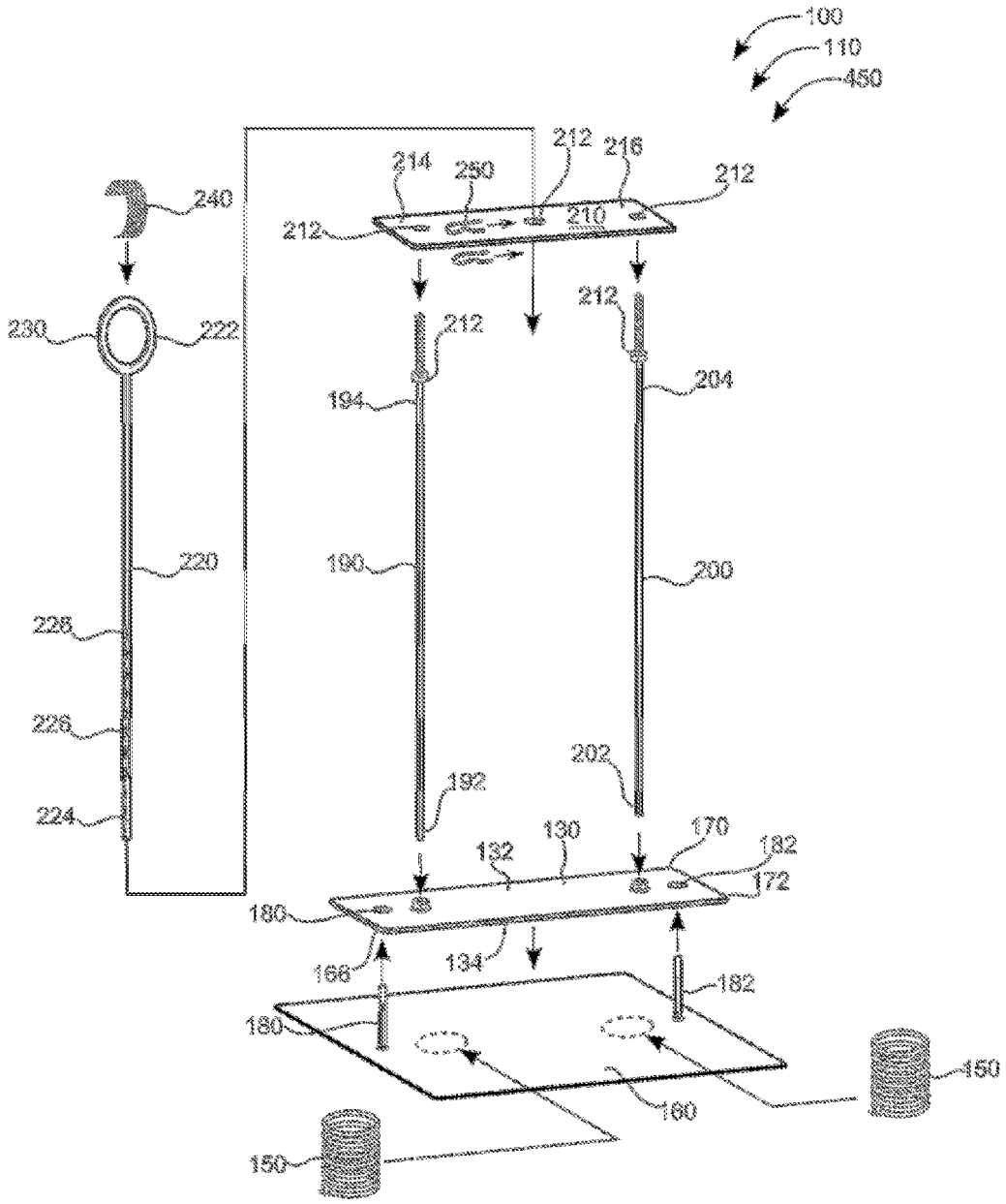
FIG. 4 is an exploded view illustrating a foot-activated toilet flushing system according to an embodiment of the present invention of FIG. 1.

Referring now to FIG. 4, an exploded view of foot-activated toilet flushing system 100 according to an embodiment of the present invention of FIG. 1.

Base plate 160 is substantially square with bottom side 164 of base plate 160 located adjacent to the surface of the floor beneath toilet flush handle 110. Base plate 160 may be about 6 inches square or may be longer and narrower in some embodiments. First guide rod 180 and second guide rod 182 are vertically positioned and rigidly attached to top side 162 of base plate 160 near opposing edges, with first guide rod 180 located about mid way between first 166 and second corner 168 and second guide rod 182 located about mid way between third 170 and forth corner 172. First 180 and second guide rod 182 may be threadably fastened to base plate 160 and comprise a cylindrical profile.

Compression springs 150 are vertically attached to top side 162 of base plate 160 between first guide rod 180 and second guide rod 182. Upper side 132 and lower side 134 of foot flush plate 130 are integral and parallel planar to each other. Foot flush plate 130 may be at least 1½ inches wide and about 6 inches long. First guide rod 180 and second guide rod 182 are able to keep foot flush plate 130 in vertical alignment. Foot flush plate 130 is positioned atop compression springs 150 with first guide rod 180 and second guide rod 182 slidably passing through first through-hole 136 and second through-hole 138, respectively, of foot flush plate 130. Foot flush plate 130 is able to float upward and downward with the compression motions of compression springs 150 via tension and compression forces.

First end 192 of first vertical extension rod 190 and proximate end 202 of second vertical extension rod 200 is removably attached at opposite ends of upper side 132 of foot flush plate 130 and are rigidly and vertically attached to foot flush plate 130. Second end 194 of first vertical extension rod 190 and distal end 204 of second vertical extension rod 200 are perpendicularly fastened to adjustment plate 210 near left outside edge 214 and right outside edge 216 of adjustment plate 210 respectively.

Foot-activated toilet flushing system 100 may be sold as kit 450 comprising the following parts: at least one foot flush assembly 105 having at least one base plate 160; at least one first guide rod 180 and one second guide rod 182; at least two compression springs 150; at least one foot flush plate 130; at least one first vertical extension rod 190 and one second vertical extension rod 200; at least one adjustment plate 210; at least one adjustment rod 220 having pull ring 230 at loop end 222 and a plurality of adjustment orifices 226 at adjustment end 224; at least one attachment strap 240; and at least one set of user instructions. The kit has instructions such that functional relationships are detailed in relation to the structure of the invention (such that the invention can be used, maintained, or the like in a preferred manner). Foot-activated toilet flushing system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
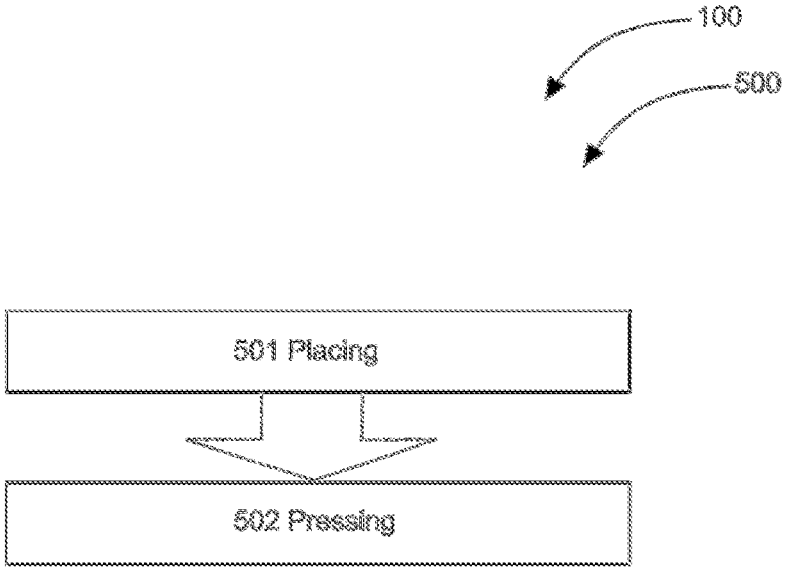
FIG. 5 is a flowchart illustrating a method of use for foot-activated toilet flushing system according to an embodiment of the present invention of FIGS. 1-4.

Referring now to FIG. 5, showing method of use 500 for foot-activated toilet flushing system 100. A method of using foot-activated toilet flushing system 100 may comprise the steps of step one 501 placing the user's 120 foot on foot flush plate 130; and step two 502 pressing downward on foot flush plate 130 to activate toilet flush handle 110 to flush toilet 140.

It should be noted that step 501 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A foot-activated toilet flushing system comprising:
- a foot flush assembly having;
  - a base plate having;
    - a top side;
    - a bottom side;
    - a first corner, a second corner, a third corner, and a forth corner;
    - a first guide rod and a second guide rod;
    - at least one compression spring;
  - a foot flush plate having;

an upper side and a lower side;
a first through-hole and a second through-hole;
a first vertical extension rod having a first end and a second end;
a second vertical extension rod having a proximate end and a distal end;
an adjustment plate having a plurality of through-orifices;
an adjustment rod having;
a loop end;
an adjustment end;
a plurality of adjustment orifices;
a pull ring; and
an attachment strap;

wherein said foot flush assembly is an apparatus attachable to a toilet flush handle such that a user is able to step on said foot flush plate to flush a toilet with a hands-free operation;

wherein said base plate is substantially square with said bottom side of said base plate located adjacent a floor surface beneath said toilet flush handle of said toilet;

wherein said first and said second guide rod are vertically positioned and rigidly attached to said top side of said base plate near opposing edges, said first guide rod located about mid way between said first corner and said second corner and said second guide rod located about mid way between said third corner and said fourth corner;

wherein said at least one compression spring is vertically attached to said top side of said base plate between said first guide rod and said second guide rod;

wherein said upper side and said lower side of said foot flush plate are integral and parallel planar to each other;

wherein said foot flush plate is positioned atop said at least one compression spring, said first guide rod and said second guide rod slidably passing through said first and said second through-holes, respectively, of said foot flush plate;

wherein said first end of said first vertical extension rod and said proximate end of said second vertical extension rod are removably attached at opposite ends to said upper side of said foot flush plate such that said first vertical extension rod and said second vertical extension rod are rigidly and vertically attached to said foot flush plate;

wherein said second end of said first vertical extension rod and said distal end of said second vertical extension rod are perpendicularly fastened to said adjustment plate near a left outside edge and a right outside edge of said adjustment plate respectively;

wherein said adjustment end of said adjustment rod perpendicularly passes through a centrally located said through-orifice of said adjustment plate and adjustably fastens to said adjustment plate via said plurality of adjustment orifices of said adjustment end of said adjustment rod;

wherein said loop end of said adjustment rod is non-removably attached to said pull ring; and wherein said pull ring is coupled to said toilet flush handle via said attachment strap such that a single downward pressing motion on said foot flush plate via a foot of said user provides a single flush of said toilet.

2. The foot-activated toilet flushing system of claim 1 wherein said foot flush assembly is able to reduce a spreading of germs by said user.

3. The foot-activated toilet flushing system of claim 1 wherein said foot flush plate is able to float upward and downward with a compression motion of said at least one compression spring via tension and compression forces.

4. The foot-activated toilet flushing system of claim 1 wherein said first guide rod and said second guide rod is able to keep said foot flush plate in vertical alignment.

5. The foot-activated toilet flushing system of claim 1 wherein said adjustment rod is able to adjust to multiple different heights to accommodate attachment to said toilet flush handle.

6. The foot-activated toilet flushing system of claim 1 wherein said attachment strap comprises hook and loop fasteners.

7. The foot-activated toilet flushing system of claim 4 wherein said first guide rod and said second guide rod is threadably fastened to said base plate.

8. The foot-activated toilet flushing system of claim 1 wherein said adjustment rod is fastened to said adjustment plate via at least one biasing clip.

9. The foot-activated toilet flushing system of claim 1 wherein said foot flush assembly is able to adjust to at least as low as 20 inches to couple to said toilet flush handle to flush said toilet.

10. The foot-activated toilet flushing system of claim 9 wherein said foot flush assembly is able to adjust to at least as high as 30 inches to couple to said toilet flush handle to flush said toilet.

11. The foot-activated toilet flushing system of claim 1 wherein said first guide rod and said second guide rod comprise a cylindrical profile.

12. The foot-activated toilet flushing system of claim 1 wherein said at least one compression spring is able to easily be compressed by a weight of said foot of said user.

13. The foot-activated toilet flushing system of claim 1 wherein said foot flush plate is at least 1½ inches wide and about 6 inches long.

14. The foot-activated toilet flushing system of claim 1 wherein said base plate is about 6 inches square.

15. The foot-activated toilet flushing system of claim 1 wherein said foot flush assembly is an add-on device and retrofits to an existing said toilet flush handle of an existing said toilet.

16. The foot-activated toilet flushing system of claim 1 wherein said foot flush assembly comprises stainless steel such that it is rigid and corrosion resistant.

17. The foot-activated toilet flushing system of claim 1 wherein said plurality of adjustment orifices of said adjustment rod are each spaced about ½ inch apart.

18. A foot-activated toilet flushing system comprising:

a foot flush assembly having;
a base plate having;
a top side;
a bottom side;
a first corner, a second corner, a third corner, and a forth corner;
a first guide rod and a second guide rod;
at least one compression spring;
a foot flush plate having;
an upper side and a lower side;
a first through-hole and a second through-hole;
a first vertical extension rod having a first end and a second end;
a second vertical extension rod having a proximate end and a distal end;
an adjustment plate having a plurality of through-orifices;
an adjustment rod having;
a loop end;

an adjustment end;
a plurality of adjustment orifices;
a pull ring; and
an attachment strap;

wherein said foot flush assembly is an apparatus attachable to a toilet flush handle such that a user is able to step on said foot flush plate to flush a toilet with a hands-free operation;

wherein said foot flush assembly is an add-on device and retrofits to an existing said toilet flush handle of an existing said toilet;

wherein said foot flush assembly comprises stainless steel such that it is rigid and corrosion resistant;

wherein said foot flush assembly is able to reduce a spreading of germs by said user;

wherein said base plate is substantially square with said bottom side of said base plate located adjacent a floor surface beneath said toilet flush handle of said toilet;

wherein said base plate is about 6 inches square;

wherein said first guide rod and said second guide rod are vertically positioned and rigidly attached to said top side of said base plate near opposing edges, said first guide rod located about mid way between said first and said second corners and said second guide rod located about mid way between said third and said fourth corners;

wherein said first and said second guide rods are threadably fastened to said base plate;

wherein said first guide rod and said second guide rod comprises a cylindrical profile;

wherein said at least one compression spring is vertically attached to said top side of said base plate between said first guide rod and said second guide rod;

wherein said at least one compression spring is able to easily be compressed by a weight of said foot of said user;

wherein said upper side and said lower side of said foot flush plate are integral and parallel planar to each other;

wherein said foot flush plate is at least 1½ inches wide and about 6 inches long;

wherein said first guide rod and said second guide rod is able to keep said foot flush plate in vertical alignment;

wherein said foot flush plate is positioned atop said at least one compression spring, said first guide rod and said second guide rod slidably passing through said first through-hole and said second through-hole, respectively, of said foot flush plate;

wherein said foot flush plate is able to float upward and downward with a compression motion of said at least one compression spring via tension and compression forces;

wherein said first end of said first vertical extension rod and said proximate end of said second vertical extension rod are removably attached at opposite ends to said upper side of said foot flush plate such that said first vertical extension rod and said second vertical extension rod are rigidly and vertically attached to said foot flush plate;

wherein said second end of said first vertical extension rod and said distal end of said second vertical extension rod are perpendicularly fastened to said adjustment plate near a left outside edge and a right outside edge of said adjustment plate respectively;

wherein said adjustment end of said adjustment rod perpendicularly passes through a centrally located said through-orifice of said adjustment plate and adjustably fastens to said adjustment plate via said plurality of adjustment orifices of said adjustment end of said adjustment rod;

wherein said plurality of adjustment orifices of said adjustment rod are spaced about ½ inch apart;

wherein said adjustment rod is fastened to said adjustment plate via at least one biasing clip;

wherein said loop end of said adjustment rod is non-removably attached to said pull ring;

wherein said adjustment rod is able to adjust to multiple different heights to accommodate attachment to said toilet flush handle;

wherein said foot flush assembly is able to adjust to at least as low as 20 inches to couple to said toilet flush handle to flush said toilet;

wherein said foot flush assembly is able to adjust to at least as high as 30 inches to couple to said toilet flush handle to flush said toilet;

wherein said attachment strap comprises hook and loop fasteners;

wherein said pull ring is coupled to said toilet flush handle via said attachment strap such that a single downward pressing motion on said foot flush plate via a foot of said user provides a single flush of said toilet.

19. The foot-activated toilet flushing system of claim 18 further comprising a kit including:

at least one said foot flush assembly having;
at least one said base plate;
at least one said first guide rod and one said second guide rod;
at least two said compression springs;
at least one said foot flush plate;
at least one said first vertical extension rod and one said second vertical extension rod;
at least one said adjustment plate;
at least one said adjustment rod having said pull ring at said loop end and a plurality of said adjustment orifices at said adjustment end;
at least one said attachment strap; and
a set of installation instructions.

* * * * *